US005131190A

United States Patent [19]

Gougouyan

[11] Patent Number: 5,131,190

[45] Date of Patent: Jul. 21, 1992

[54] LAPPING MACHINE AND NON-CONSTANT PITCH GROOVED BED THEREFOR

[75] Inventor: Yves Gougouyan, Paris, France

[73] Assignee: C.I.C.E. S.A., France

[21] Appl. No.: 648,287

[22] Filed: Jan. 31, 1991

[30] Foreign Application Priority Data

Feb. 23, 1990 [FR] France ..... 90 02290

[51] Int. Cl.[5] ..... B24B 7/22; B24D 7/10

[52] U.S. Cl. ..... 51/129; 51/132; 51/131.2; 51/209 R; 51/209 DL

[58] Field of Search ..... 51/129, 131.3, 131.2, 51/131.1, 209 R, 209 DL, 209 S, 132, DIG. 6, 267, 292, 283 R

[56] References Cited

U.S. PATENT DOCUMENTS

| | | | |
|---|---|---|---|
| 783,086 | 2/1905 | Stewart | 51/209 S |
| 2,762,172 | 9/1956 | Franklin | 51/129 |
| 2,820,334 | 1/1958 | Touvay | 51/209 R |
| 3,457,682 | 7/1969 | Boettcher et al. | 51/129 |
| 3,921,342 | 11/1975 | Day | 51/209 DL |
| 4,918,872 | 4/1990 | Sato et al. | 51/209 R |
| 5,020,283 | 6/1991 | Tuttle | 51/209 DL |

FOREIGN PATENT DOCUMENTS 2485422 12/1981 France .

OTHER PUBLICATIONS

Convex Wafer Fabrication; Fleury et al, IBM Technical Disclosure Bulletin; vol. 21, No. 4 (Sep. 1978); pp. 1486–1487.

*Primary Examiner*—Robert A. Rose
*Attorney, Agent, or Firm*—Remy J. VanOphem

[57] ABSTRACT

A lapping machine having a lapping bed adapted to rotate about a main axis and having an annular lapping surface delimited by an inner circle and an outer circle and into which is cut a spiral groove. Virtually all of at least one confinement ring faces the annular surface and rotates about a fixed axis parallel to the main axis, contains parts to be lapped, and confines movement thereof against the lapping surface. An application disk coaxial with the ring presses the parts in the axial direction agains the lapping surface. The pitch of the groove is not constant whereby between the inner and outer circles, and excluding the inner and outer circles, there is a constant ratio between the pitch ratio λ of the bed at a distance R from the main axis, defined by the ratio between the radial dimension of the solid part of the pitch and its overall dimension, and the angular amplitude of an arc centered on the main axis, of radius equal to the distance R, and intercepted internally by the confinement ring, whatever the distance R.

12 Claims, 3 Drawing Sheets

LAPPING MACHINE AND NON-CONSTANT PITCH GROOVED BED THEREFOR

BACKGROUND OF THE INVENTION

1. Field of the Invention

The invention concerns flat lapping machines and lapping beds for such machines.

2. Description of the Prior Art

Very flat surfaces of high quality are usually produced by lapping, a machining operation in which material is removed by means of an abrasive such as silicon carbide, alumina, diamond, etc., in suspension in a fluid such as water, oil, kerosine, etc., deposited onto a surface (bed) which is moved relative to the surface of the parts to be lapped. The movement of the abrasive particles relative to the surface of the parts removes material and the suspension liquid, to which a lubricant liquid to favor cutting may be added, removes the waste material, reduces the direct friction between the surface of the bed and the surface of the parts, and acts as a coolant. Pressure is applied to the opposite side of the parts to be lapped to control the rate at which material is removed.

The quality of the flatness achieved at the surface of the parts is directly related to the flatness of the lapping bed and to the ratio between the diameter of the parts and the diameter of the lapping bed.

Flat lapping machines are so constructed that the path of movement of the parts on the surface of the bed is the resultant of two circular movements: rotation of the bed about its axis, and rotation of the parts about axes perpendicular to the surface of the bed and offset relative to its center.

The parts are placed loose in bulk or in circular plates incorporating cells, inside rings usually of metal which confine their movement on the surface of the bed. A metal disk rests on the other side of the parts and transmits the force applied by a piston-and-cylinder actuator or by weights to the parts. A sheet of felt may be provided between the metal disk and the parts.

The rings are distributed circumferentially about the axis of the bed at equal distances from its axis. There are usually three or four rings, their axes being fixed relative to that of the bed and on radii spaced by 120° for three rings or 90° for four rings.

The rings can rotate freely, as a result of the resultant force due to the differential friction forces generated by the relative linear speeds of the parts relative to the center of the bed, or by being driven by a motor or by a toothed wheel driven by the bed and meshing with teeth cut into the perimeter of the rings.

In the case of fine lapping of parts made from hard materials such as ceramics, where the flatness required is in the order of 0.6 μm or better and the roughness required is in the order of 0.25 μm Ra or better, the lapping bed has a spiral groove of constant pitch and geometry on its surface to enable rapid evacuation of the waste material and so prevent the formation of a thick film between the parts and the bed which could compromise flatness.

Various machines commercially available worldwide use the principles described above. Examples of such machines are SPEEDFAM, PETER WOLTERS, and STAHLI.

It will be appreciated that with this kind of arrangement the correct disposition of the parts within the rings enables the parts to sweep over all the surface of the bed so that the latter tends to be worn down equally in all parts.

This is satisfactory if extremely precise flatness is not required but proves to be inadequate when precise flatness is required in the manufacture of very large numbers of parts. In this case, it is necessary to maintain the flatness of the lapping bed and to compensate for differential wear phenomena to which it is subject and which results in hollowing out of the bed.

Various methods are used to prevent irregular wearing away of the bed. They include reversing the direction of forced rotation of the rings relative to the surface of the bed at regular intervals; prestressing the bed so that its surface bulges, which prestressing is released as the bed is worn down; and variable positioning of the rotation axis of each ring relative to the center of the bed.

All these methods have been found to be somewhat ineffective and, most importantly, to compromise productivity. Although differential wearing of the bed can be partially compensated or slowed down, this is achieved as the result of costly operations which waste time and require highly qualified personnel to inspect the bed at regular intervals.

An object of the invention is to alleviate the abovementioned disadvantages by means of a bed geometry which is designed to wear away regularly under the conditions of use explained above.

SUMMARY OF THE INVENTION

According to one embodiment the invention is a lapping machine including a lapping bed adapted to rotate about a main axis and having an annular lapping surface delimited by an inner circle and an outer circle and into which is cut a spiral groove. At least one confinement ring is provided, virtually all of which faces the annular surface and which is adapted to rotate about a fixed axis parallel to the main axis. The ring is adapted to contain parts to be lapped and to confine movement thereof against the lapping surface, and an application disk is coaxial with the ring and adapted to press the parts in the axial direction against the lapping surface. The pitch of the groove in the machine is not constant whereby between the inner and outer circles, and excluding the inner and outer circles, there is a constant ratio between the pitch ratio $\lambda$ of the bed at a distance R from the main axis, where the pitch ratio is defined by the ratio between the radial dimension of the solid part of the pitch and its overall dimension, and the angular amplitude of an arc centered on the main axis, of radius equal to the distance R, and intercepted internally by the confinement ring, whatever the distance R.

Preferably the confinement ring projects in the radial direction to either side of the annular lapping surface and the inside diameter of the confinement ring has a value between 101 and 105% of the distance between the inner and outer circles and is approximately centered halfway between the circles. It is also preferable that the pitch ratio for the inner circle is between the minimal pitch ratio for the outer circle and the maximal pitch ratio substantially half way between the circles, and that the pitch ratio is above a minimum threshold of 25%. According to a further feature of the invention, the ring is adapted to rotate freely about its axis, and the confinement ring is part of a plurality of identical confinement rings regularly distributed in the circumferential direction about the main axis at equal distances therefrom.

In another embodiment of the invention, a lapping bed for use in a lapping machine is provided which has an annular lapping surface delimited between an inner circle and an outer circle and into which is cut a spiral groove. The pitch of the groove is not constant whereby between the circles and at a distance therefrom there is a constant ratio between the pitch ratio λ of the bed at a distance R from the center of the bed. The pitch ratio is defined by the ratio between the radial dimension of the solid part of the pitch and its overall dimension, and the angular amplitude of an arc with radius equal to the distance R, coaxial with the bed, and intercepted internally by an arbitrary circle facing the annular lapping surface approximately tangential to the circles, whatever the distance R.

Preferably the arbitrary circle projects slightly in the radial direction to either side of the annular lapping surface, and the diameter of the arbitrary circle has a value between 101 and 105% of the distance between the inner and outer circles. It is also preferred that the pitch ratio for the inner circle be between the minimal pitch ratio for the outer circle and the maximal pitch ratio substantially half way between the circles, and that the pitch ratio is greater than a minimum threshold of 25%.

Objects, characteristics and advantages of the invention will emerge from the following description given by way of non-limiting example only and with reference to the appended diagrammatic drawings.

DETAILED DESCRIPTION OF THE PREFERRED EMBODIMENT

Figure 2:
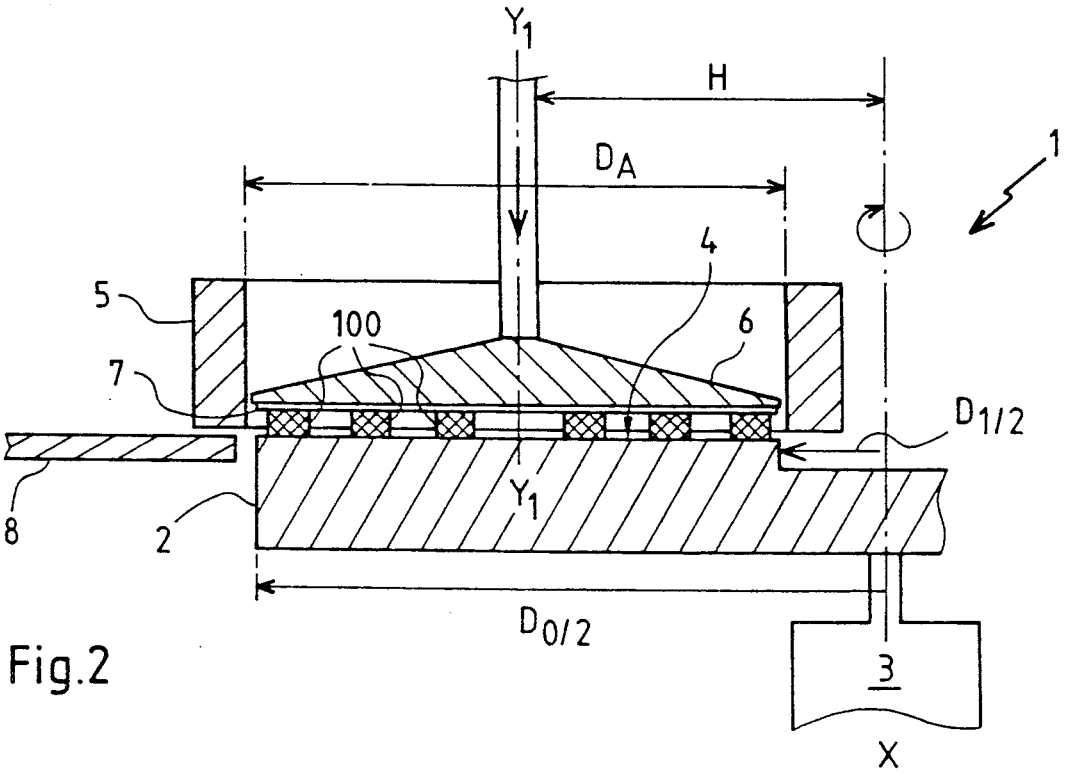
FIG. 2 is a view of the lapping machine in vertical cross-section taken along line II—II in FIG. 1 passing through the axis of rotation of the lapping bed and the axis of rotation of one of the confinement rings.
Figure 1:
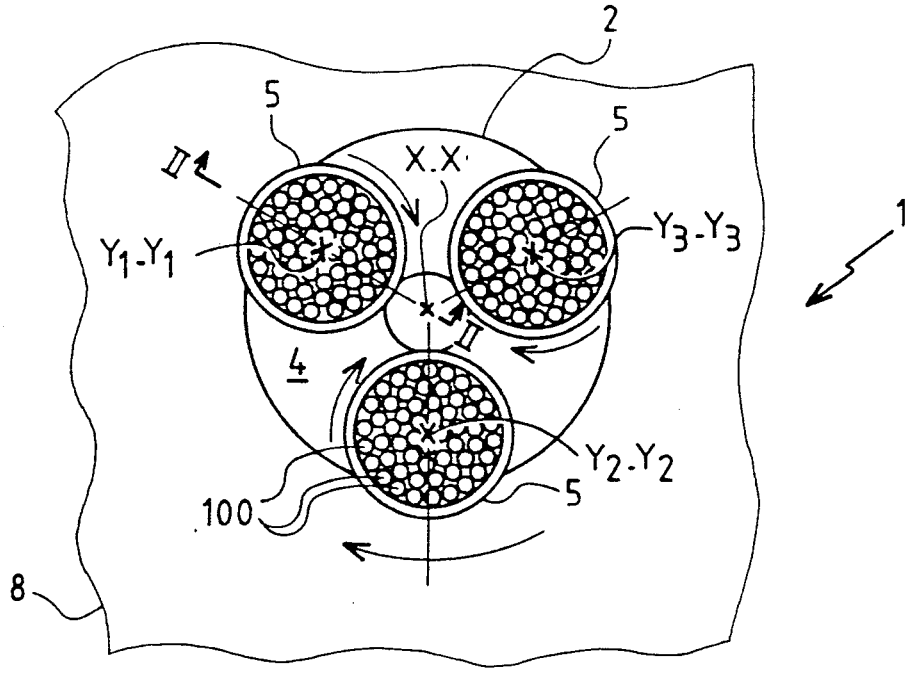
FIG. 1 is a partial plan view of a lapping machine with no pressure disks.
Figure 3:
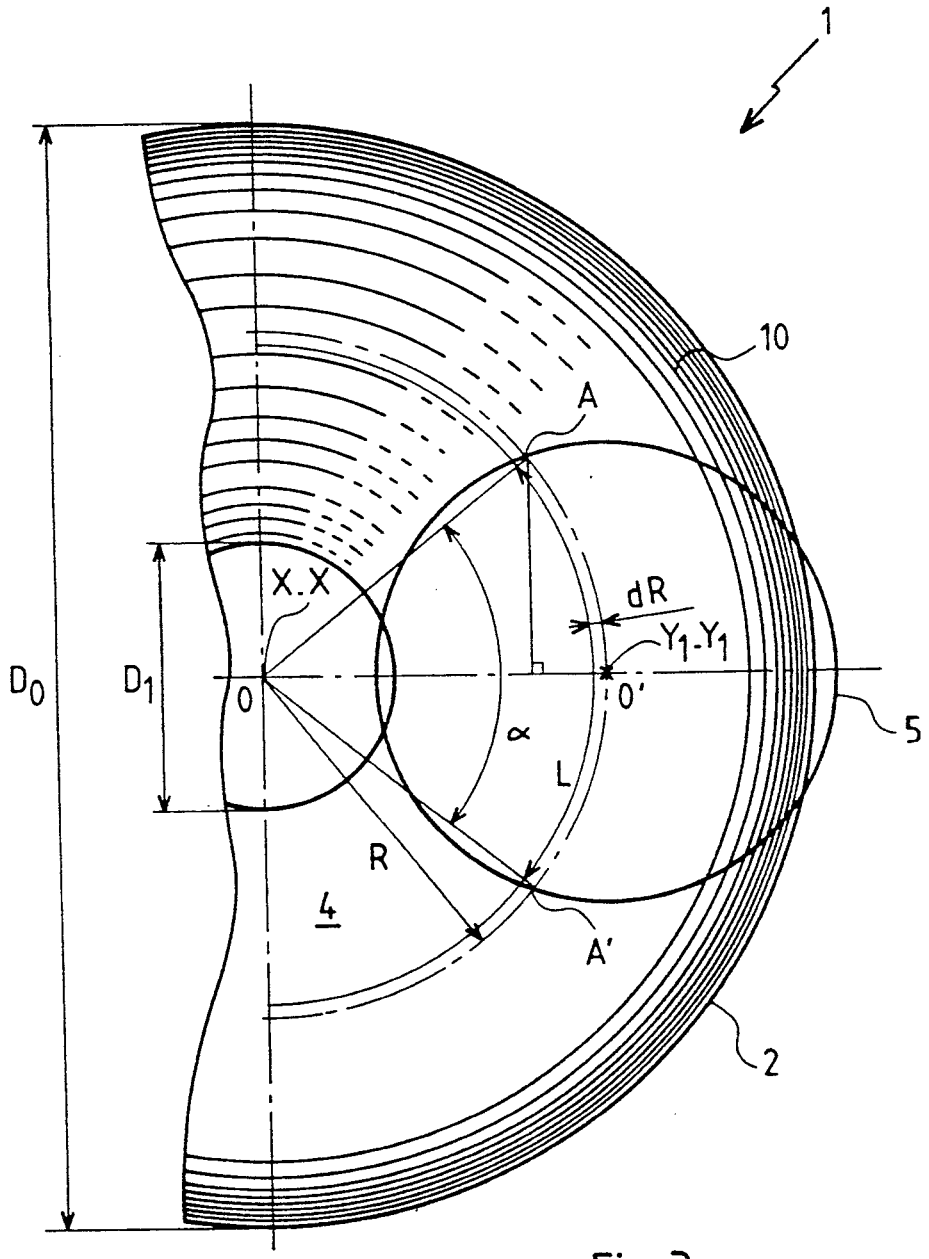
FIG. 3 is a schematic plan view of the lapping bed and one ring.

FIGS. 1 through 3 show the main component parts of a lapping machine 1.

The machine has a bed 2 which is rotated about a vertical axis X—X by any appropriate known drive means 3.

The bed 2 has an annular portion or "strip" 4 delimited by an inner circle of diameter $D_0$ and an outer circle of diameter $D_1$.

Parts 100 to be lapped are placed on the strip 4. They are, for example, cylindrical ceramic pads, and are disposed inside three rings 5 offset angularly at 120° to each other.

To simplify FIG. 2 the parts 100 are shown at a considerable distance from each other. In practice they are contiguous as better illustrated in FIG. 1.

The rings 5 are adapted to rotate about their fixed axes $Y_1$—$Y_1$, $Y_2$—$Y_2$ and $Y_3$—$Y_3$ parallel to the axis X—X and at the same distance H from the axis X—X.

If $D_A$ is the inside diameter of the rings 5 and d is the diameter of the parts 100, then:

$$DA \leqq (D_0 - D_1)/2 + d$$

The rings 5 confine movement of the parts 100 on the surface of the bed between the circles with diameters $D_0$ and $D_1$.

The parts 100 are pressed against the surface of the bed 2 by pressure disks 6 coaxial with the rings 5, usually through a layer of felt 7. A force P is applied to the disks 6 by piston-and-cylinder actuators or weights (not shown). The arrangements for holding these disks 6 in position assist in holding the rings 5 in position.

The bed 2 is located in a circular opening in a worktable 8 whose upper surface is flush with the surface of the bed 2, enabling the parts 100 to be slid onto and off the bed 2.

These arrangements are conventional and will not be described in more detail here.

Also in a manner that is conventional in itself, a spiral groove 10 is formed in the lapping surface.

However, the groove 10 is not conventional in the sense that its pitch is not constant but rather varies so as to maintain constant for any value of the distance from the X—X axis the ratio between the surface area of the parts 100 to be lapped and the facing surface area of the bed 2.

This is based on an in-depth analysis of the causes of differential wear of known constant pitch grooved beds.

It has been found that the differential wear is the combined result of two phenomens: 1) increasing wear of the strip 4 on moving from the diameter $D_0$ towards the diameter $D_1$, towards the center of the bed 2, which causes hollowing out of the bed 2; and 2) greater wear of the central area of the strip 4 relative to its edges, with the maximum wear in the vicinity of the area containing the axis of the rings 5.

This can be explained as follows.

First, for parts situated along the rings 5 the quantity of material of the bed 2 is less at its center than at its periphery. For a strip 4 of the bed 2 of width dx, for the same surface area of the facing parts 100, the surface area of the strip 4 is:

$\pi D_1.dx$ at the inside edge of the strip 4, and $\pi D_0.dx$ at the outside edge of the strip 4.

The quantity of parts 100 is greater at the center of the rings 5 than at their periphery because of their circular shape. A circular strip 4 of the bed 2 of diameter D centered on the center of the bed 2 and such that $D_1 < D < D_0$ will intercept more parts if $D \sim (D_0 - D_1)/2 + D_1$ than if $D \sim D_0$ or $D \sim D_1$.

The following notation is used hereinafter:

P: the pitch of the groove 10 at the distance R from the axis X—X, a: the solid part of the pitch at this distance R, b: the hollow part of the pitch at this distance R, λ: the pitch ratio of the bed 2 at this distance R, defined by $$\lambda = a/P = a/(a+b),$$

the angle subtended by the arc of radius R intercepted by the rings 5 of diameter $D_A$ with its center at a distance H from the axis X—X, and L: the length of the arc.

For any value of R between $D_1$ and $D_0$ (or if $D_A$ is too small, between $H-D_A/2$ and $H+D_A/2$), by neglecting the interstices between contiguous parts within the rings 5, the area of the parts 100 to be lapped for each ring 5 can be written:

$$L.dR=\alpha.R.dR$$

If N denotes the number of rings 5, then for each value of R there is an area of parts 100 to be lapped:

$$dS_1=N.\alpha.R.dR$$

The bed 2 has an annular lapping strip 4 of radius R. Given the local value of the pitch ratio, the effective abrasion area is:

$$dS_2=2\pi.\lambda.R.dR$$

To obtain uniform wear across the lapping surface of the bed 2 the invention requires that the ratio $dS_1/dS_2$ is maintained constant. After simplifying the equation, and defining K as an arbitrary constant coefficient, this condition can be written:

$$\lambda=K.\alpha$$

Those skilled in the art will know how to develop the expression for $\alpha$ as a function of the variable R and of the parameters $D_A$ and H. To provide an example, it is possible to begin with the equations of any triangles applied to the triangle OAO' in FIG. 3:

$$\tan(\alpha/2)=\sqrt{\frac{(p-OA)(p-OO')}{p(p-OA')}}$$

in which p is the half perimeter of the triangle, that is:

$$p=(H+D_A/2+R)/2$$

By substituting:

$$X=H+D_A/2 \text{ and } Y=H-D_A/2$$

the expression containing $\alpha$ becomes:

$$\tan(\alpha/2)=\sqrt{\frac{(X-R)(R-Y)}{(X+R)(R+Y)}}$$

from which the expression for and therefore that for can be deduced:

$$\lambda=2\cdot K\cdot \text{Arc}\tan\left(\sqrt{\frac{(X-R)(R-Y)}{(X+R)(R+Y)}}\right)$$

Note that this expression has a null value for the extreme values (X and Y) of R. For this reason the invention teaches that the above expression is applied only for values R which are not equal to X or Y and which lie between X and Y.

There are various ways to choose the pitch ratio with reference to these extreme values X and Y. In particular, the pitch ratio may be kept constant at a predetermined threshold value, for example, $\frac{1}{3}$, $\frac{1}{4}$ or even 1/5. Another solution is to suddenly reduce the pitch ratio to a null value near the extreme value, which amounts to choosing a value for $D_1/2$ slightly (a few %) greater than Y and a value for $D_0/2$ slighly (a few %) less than X.

In practice the solution chosen is of relatively minor importance provided that the equation given above is complied with for virtually all of the (Y, X) interval, for example over 90% or even 95% of this interval.

Note that in the example shown in FIGS. 1 through 3 the second of the above solutions is adopted so that $D_A$ is slightly greater than $(D_0-D_1)/2$. The magnitude of the difference is chosen according to the diameter of the parts 100 to be lapped. In practice the parts 100 must always cover a majority, more than 50%, of the active surface of the bed 2.

As a general rule, the inner circle of the rings 5 is approximately tangential to the circles of diameters $D_1$ and $D_2$ preferably projecting freely outside the strip 4.

Figure 4:
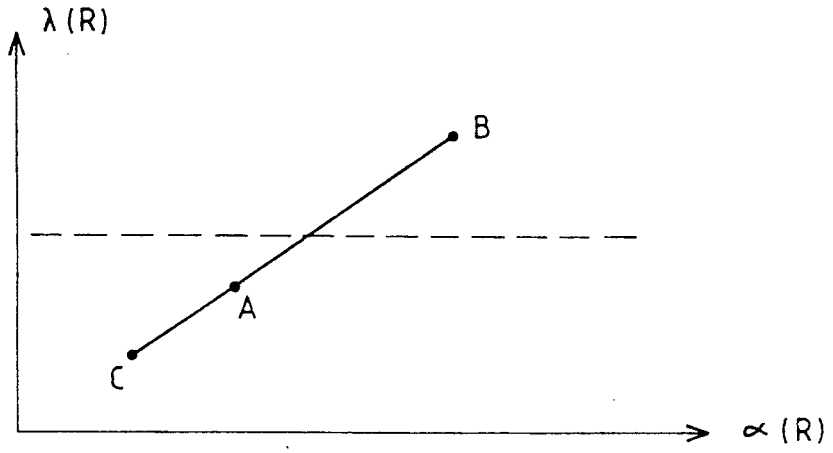
FIG. 4 is graph showing the correlation between the pitch ratio of the bed and the arc length intercepted by the ring at various distances from the axis.
Figure 5A:
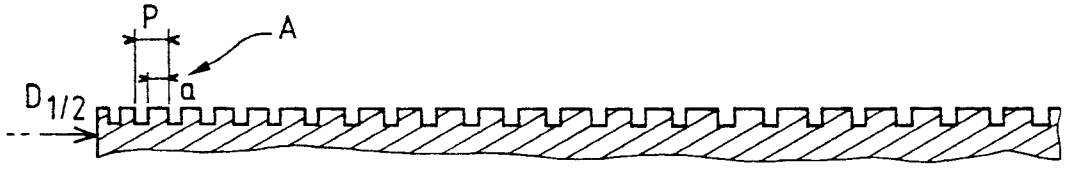
FIGS. 5A through 5C are partial views of the bed in cross-section, respectively, in a radially inside portion thereof, in a central portion thereof and in a radially outside portion thereof.
Figure 5B:
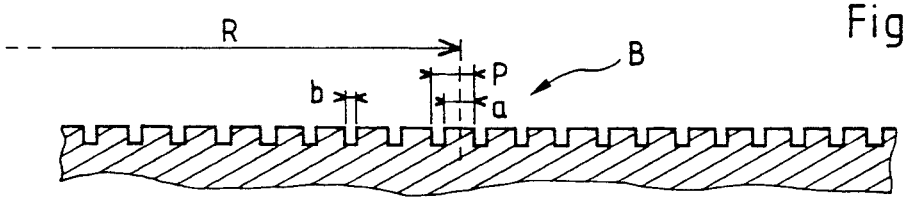

A minimal pitch ratio value is preferably chosen which is smaller at the outside periphery (point C in FIG. 4 and FIG. 5C) than at the inside periphery (point A in FIG. 4 and FIG. 5A), the pitch ratio value being maximal midway between these peripheries (point B in FIG. 4 and FIG. 5B).

FIG. 4 shows the linear relationship secured by the invention between $\lambda$ and $\alpha$; this line should be compared with the dashed horizontal line representing the prior art's constant pitch ratio.

Figure 5C:
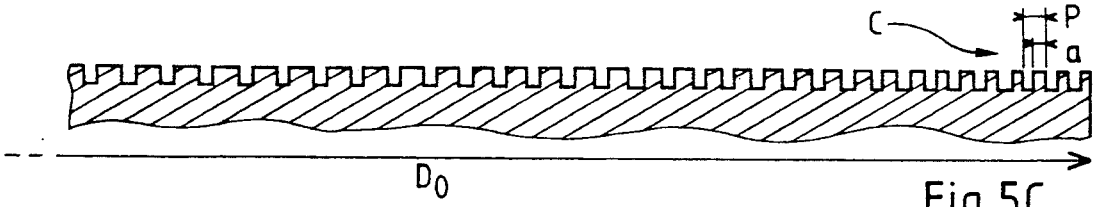

FIGS. 5A through 5C show the profile along a radius of one embodiment of the lapping bed 2. Note that from the outside periphery the pitch ratio increases from a minimal of about $\frac{2}{3}$ (FIG. 5B) from which it falls to around $\frac{1}{2}$ (FIG. 5A). For parts 100 to be lapped with a diameter between 15 and 40 mm, these values represent:

$D_1=214$
$D_0=801$
$H=257$
$D_A=153$

Note that the difference between $D_1/2$ and $(H-D_A/2)$ is approximately 3 mm and that the difference between $(H+D_A/2)$ and $D_0/2$ is approximately 9.5 mm.

Those skilled in the art will know how to determine the path of the groove 10 from the value of $\lambda$. The groove 10 is machined on a numerically controlled machine tool, for example, horizontally or vertically according to the diameter of the bed. The cross-section of the groove 10 depends on the application of the bed 2 (diamond, Borazon, etc., lapping).

Determining the path of the groove 10 requires additional information in regard to a, b or P.

In practice, a constant value, approximately 2 mm in this example, is chosen for b to facilitate machining; from this the relationship between P (or a) and $\lambda$ is readily deduced.

For example, an arbitrary initial value for the pitch ratio is imposed at the outside periphery, the value of K is deduced from this, and then the groove 10 is plotted turn by turn, calculating the pitch P using an iterative method.

The cross-section of the groove 10 having been chosen according to the application of the bed 2 (diamond, Borazon, etc., lapping), the tool is fixed to the carriage of a numerically controlled lathe, horizontally or vertically according to the diameter of the bed 2.

The initial value of the pitch chosen determines the "cutting capacity" of the bed 2:

low value = efficient, but short-lived bed, high value = less efficient bed or bed requiring powerful machinery (pneumatic actuators for applying pressure to the parts and powerful bed drive motor) but with an extended service life.

The invention has made it possible to optimize the bed 2 to a very significant degree because, rather than the bed 2 requiring periodic machining as in the case of a constant pitch groove, for example, every ten hours of machine operating time, the bed 2 from FIGS. 5A through 5C is able to operate uninterruptedly until virtually entirely worn down (virtually complete elimination of "teeth" between the turns of the groove 10), representing more than one hundred hours of machine operation.

It has been found that using non-constant pitch groove beds 2 makes it possible to dispense with any specific means for rotating the rings 5 about their respective axes.

It goes without saying that the foregoing description has been given by way of non-limiting example only and that numerous modifications thereto may be made by those skilled in the art without departing from the scope of the invention.

What is claimed is:

1. A lapping machine comprising:

a lapping bed adapted to rotate about a first axis, said lapping bed having an annular lapping surface delimited by an inner circle and on outer circle, said annular lapping surface having a spiral groove cut therein;

at least one confinement ring opposing said annular lapping surface, said at least one confinement ring being adapted to rotate about a second axis parallel to said first axis, said at least one confinement ring being adapted to receive parts to be lapped so as to confine movement thereof relative to said lapping surface; and an application disk coaxial with said at least one confinement ring adapted to press said parts in an axial direction against said annular lapping surface;

wherein said spiral groove has a variable pitch such that between said inner and outer circles, and excluding said inner and outer circles, there is a constant ratio between a pitch ratio of said lapping bed at a distance R from said first axis, said pitch ratio being a ratio between a radial dimension of a solid portion of said variable pitch and a radial dimension of said variable pitch, and an angular amplitude of an arc centered on said first axis and having a radius equal to said distance R so at to be intercepted internally by said at least one confinement ring.

2. A lapping machine according to claim 1 wherein said at least one confinement ring projects in a radial direction to either side of said annular lapping surface.

3. A lapping machine according to claim 2 wherein an inside diameter of said at least one confinement ring has a value between 101 and 105% of a radial distance between said inner and outer circles and is approximately centered between said inner and outer circles.

4. A lapping machine according to claim 1 wherein said pitch ratio for said inner circle is between a minimal pitch ratio for said outer circle and a maximal pitch ratio substantially halfway between said inner and outer circles.

5. A lapping machine according to claim 1 wherein said pitch ratio is greater than 0.25.

6. A lapping machine according to claim 1 wherein said at least one confinement ring is adapted to rotate freely about said second axis.

7. A lapping machine according to claim 1 wherein said at least one confinement ring is a plurality of substantially identical confinement rings distributed uniformly about said first axis at substantially equal distances therefrom.

8. A lapping bed for use in a lapping machine and adapted to rotate about an axis, said lapping bed comprising: an annular lapping surface delimited between an inner circle and an outer circle, said annular lapping surface having a spiral groove cut therein, said spiral groove having a variable pitch such that between said inner and outer circles and at a distance therefrom there is a constant ratio between a pitch ratio of said lapping bed at a distance R from said axis, said pitch ratio being a ratio between a radial dimension of a solid portion of said variable pitch and a radial dimension of said variable pitch, and an angular amplitude of an arc centered on said axis and having a radius equal to said distance R so at to be intercepted internally by a circle facing said annular lapping surface approximately tangential to said inner and outer circles.

9. A lapping bed according to claim 8 wherein said circle projects in a radial direction to either side of said annular lapping surface.

10. A lapping bed according to claim 9 wherein a diameter of said circle has a value between 101 and 105% of a radial distance between said inner and outer circles.

11. A lapping bed according to claim 8 wherein said pitch ratio for said inner circle is between a minimal pitch ratio for said outer circle and a maximal pitch ratio substantially halfway between said inner and outer circles.

12. A lapping bed according to claim 8 wherein said pitch ratio is greater than 0.25.

* * * * *

UNITED STATES PATENT AND TRADEMARK OFFICE

CERTIFICATE OF CORRECTION

PATENT NO. : 5,131,190

DATED : July 21, 1992

INVENTOR(S) : Yves Gougouyan

It is certified that error appears in the above-identified patent and that said Letters Patent is hereby corrected as shown below:

Title page, Abstract, line 10, delete "agains" and insert ---- against ----.

Column 5, line 51, after "for", first occurrence, insert ---- a ----; same line, after "for", second occurrence insert ---- $\lambda$ ----.

Column 6, line 2, delete "slighly" and insert ---- slightly ----.

Column 7, line 29, delete "on" and insert ---- an ----.

Column 8, line 37, delete "at" and insert ---- as ----.

Signed and Sealed this

Twenty-first Day of September, 1993

Bruce Lehman

*Attest:*

BRUCE LEHMAN

*Attesting Officer*

*Commissioner of Patents and Trademarks*